United States Patent [19]

Eggenberger et al.

[11] 4,063,228

[45] Dec. 13, 1977

[54] MOISTURE DETECTOR FOR STEAM LINE

[75] Inventors: Markus A. Eggenberger, Schenectady; Edward H. Miller, Rexford, both of N.Y.

[73] Assignee: General Electric Company, Schenectady, N.Y.

[21] Appl. No.: 753,213

[22] Filed: Dec. 22, 1976

[51] Int. Cl.[2] ..... G08B 21/00; G01N 25/60

[52] U.S. Cl. ..... 340/239 R; 73/29; 73/212; 340/235

[58] Field of Search ..... 340/239 R, 228 R, 227.1, 340/235, 213 R; 73/17 A, 29, 212

[56] References Cited

U.S. PATENT DOCUMENTS

| | | | |
|---|---|---|---|
| 2,316,624 | 4/1943 | Romanelli | 73/29 |
| 2,489,455 | 11/1949 | Leone | 73/29 X |
| 2,642,737 | 6/1953 | Kinsella | 73/29 |
| 2,946,221 | 7/1960 | Annear et al. | 73/212 |
| 3,358,738 | 12/1967 | Chambers | 340/228 R X |
| 3,413,838 | 12/1968 | Duddy | 73/29 |
| 3,573,019 | 3/1971 | Rees | 73/212 X |
| 3,688,295 | 8/1972 | Tsoras et al. | 340/228 R X |
| 3,991,603 | 11/1976 | Wonn et al. | 73/29 |

*Primary Examiner*—John W. Caldwell, Sr.
*Assistant Examiner*—Daniel Myer
*Attorney, Agent, or Firm*—James W. Mitchell; John F. Ahern; Herbert E. Messenger

[57] ABSTRACT

In a steam turbine, the presence of water slugs can have an adverse effect on certain turbine parts. One particular area of concern is the low-pressure end of the turbine wherein excess moisture is more likely to occur. Another source of moisture is an extraction line interconnecting a turbine stage with a feedwater heater. It is possible for wet steam and/or water slugs to travel from the feedwater heater to the turbine and vice-versa. The present invention provides a monitoring device for a steam conduit which detects the presence of water slugs or wet steam in a steam conduit and will further indicate a reverse direction of flow in the steam conduit.

11 Claims, 2 Drawing Figures

MOISTURE DETECTOR FOR STEAM LINE

This invention relates, in general, to monitoring devices and, in particular, this invention comprises a device which may be used in combination with a steam turbine for detecting the presence of excess moisture in certain turbine parts.

In an axial flow steam turbine, excess moisture in the form of water slugs or water drops can cause damage to the turbine blades. The damage may be in the form of blade cracking or blade erosion as the relatively high velocity turbine blades collide with the relatively low velocity moisture droplets. The moisture may occur within the turbine itself or the moisture may be introduced into the turbine from the feedwater heaters vis-a-vis a reverse flow through a steam extraction line interconnecting the turbine shell and a particular feedwater heater. In addition water can also cause thermal distortion of stationary parts which in turn may cause rubs, high vibration, and loss of efficiency. In any event, it is important to detect the presence of excess moisture in the working fluid of a steam turbine in order that corrective action may be taken prior to the occurrence of blade damage. In a preferred embodiment of the present invention, the presence of excess moisture is detected in an extraction line of a steam turbine.

SUMMARY OF THE INVENTION

The present invention is a monitoring device which detects the presence of excess moisture in a steam flow path such as a steam extraction line. Sensing devices may detect a rapidly changing steam condition such as a water slug which may travel in either direction in an extraction line. Moreover, the sensing devices may detect a more slowly occurring moisture increase condition such as wet steam in the steam flow path. Finally, the sensing devices will indicate the flow direction of the increased moisture condition.

The output of the sensing devices may be recorded to provide a continuous profile of steam conditions. Logic circuitry is provided in combination with alarms to indicate a critical condition in the monitored steam flow path. While one preferred embodiment of the present invention contemplates the monitoring of an extraction line at the low-pressure end of a steam turbine, it will become clear that such a preferred embodiment is illustrative and that the present invention may be incorporated into any steam flow path wherein the detection of excess moisture is important or likely to occur. For example, the present invention may be reasonably employed in the steam conduit upstream from the turbine inlet valves.

OBJECTS OF THE INVENTION

It is an object of the present invention to provide a monitoring device for a steam flow path.

It is another object of the present invention to provide a means for detecting water slugs and wet steam conditions in a steam flow path and for determining the direction of flow.

It is another object of the present invention to provide an alarm signal whenever steam moisture conditions increase to a predetermined level.

Finally, it is an object of the present invention to provide a monitoring device in combination with a steam turbine for detecting potentially adverse excess moisture conditions in the steam flow.

Other objects, advantages and features of the present invention will become apparent from the following description of a preferred embodiment thereof when taken in connection with the accompanying drawing.

DETAILED DESCRIPTION OF THE INVENTION

Figure 1:
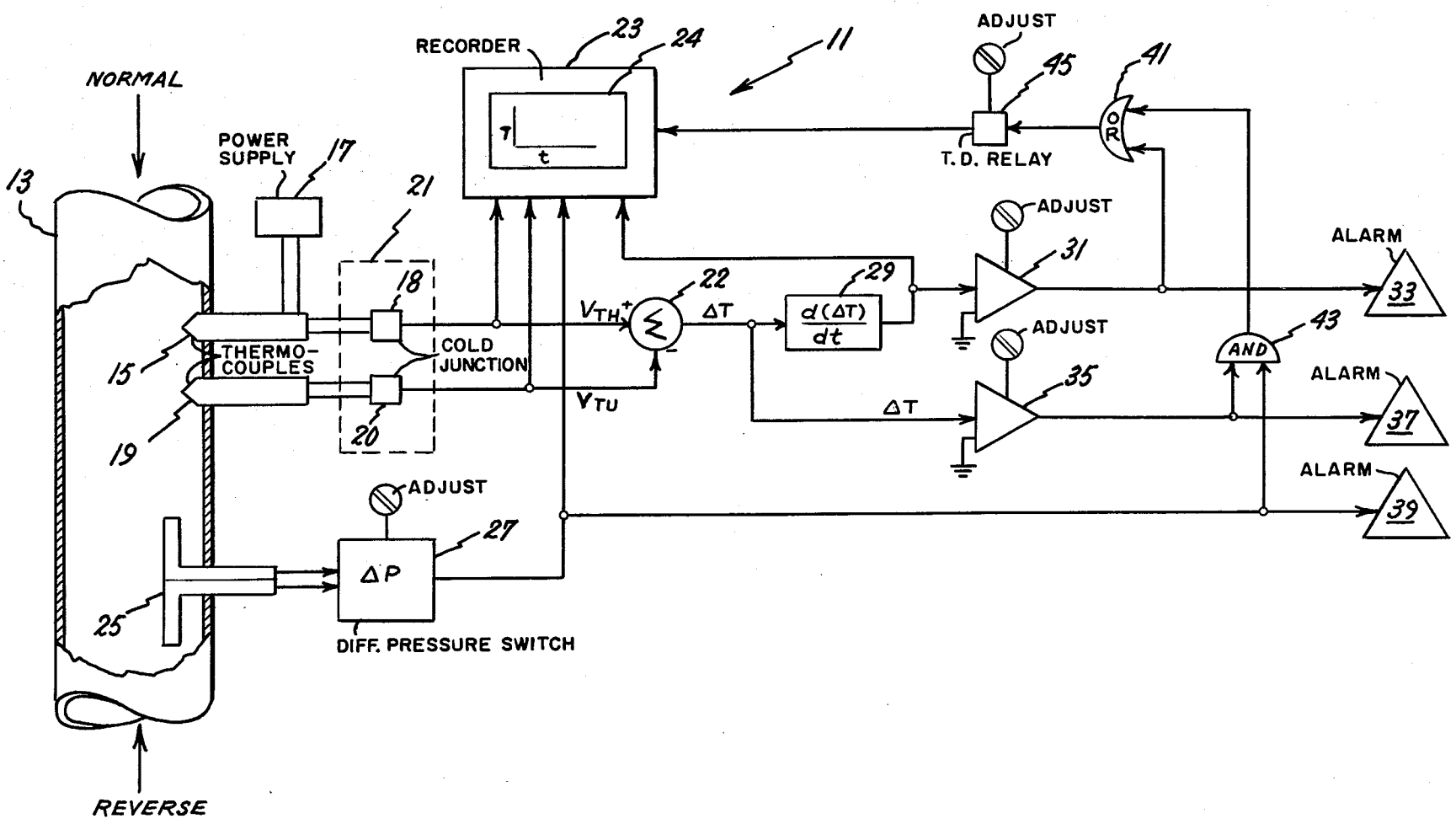
FIG. 1 shows the present invention in schematic form and includes a steam conduit, sensing means, logic circuitry, alarms and a recording device.

Referring to FIG. 1, a monitoring device 11 according to the present invention is shown in conjunction with a steam flow path in the form of a conduit 13. The conduit may be any steam flow path and, in particular, in accordance with a preferred embodiment of the invention, the conduit is representative of an extraction steam line interconnecting a steam turbine shell with a feedwater heater as illustrated in U.S. Pat. No. 3,604,206 to Baily at parts 18 and 19. Although that patent is directed to an invention unrelated to the present invention, it shows one enviroment in which the present invention may be advantageously employed and is incorporated herein by reference.

The monitoring device, according to the present invention, includes a first thermal sensing device 15 which is heated by an electrical power supply 17. A commercial version of this device is available from Thermocouple Products Co., Winfield, Illinois under the model number TCP P/N M-2445. The power supply is a 5W constant voltage power supply. The output of the heated thermal sensor is a voltage $V_{TH}$.

A second thermal sensing device 19 is at ambient temperature and may be any commercially available thermocouple which is made of the same material as the heated thermocouple. The output of the second thermal sensing device is a voltage $V_{TU}$. The cold junctions 18 and 20 of the respective heated and unheated thermocouples are combined in an enclosure 21 to assure equal temperatures on both cold junctions. The thermal sensor output $V_{TU}$ is subtracted from $V_{TH}$ in a summing device 22 to provide a voltage difference $\Delta T$. At no flow $\Delta T$ is equal to 1 (normalized $\Delta T$). At a dry flow $\Delta T$ is in the range of .5 and at wet flow $\Delta T$ is in the range of 0.07. The respective voltage outputs $V_{TH}$ and $V_{TU}$ may be charted in a recorder device 23. $\Delta T$ will decrease as the moisture content of the steam increases because of the change in the heat transfer coefficient of the steam.

The monitoring device also includes a forward-reverse tube 25 disposed in the steam conduit, the output of the forward-reverse tube being connected to an adjustable differential pressure switch 27 which provides an output voltage whenever there is a reverse flow in the steam conduit exceeding a preselected limit $\Delta P$. As an example, the pressure switch 27 will turn on whenever the pressure differential is equal to or exceeds $-2$ inches $H_2O$ in the negative direction. The voltage output of the pressure switch may also be input into a recorder 23. The recorder may include a chart 24 for graphically displaying the recorder input information.

The summing device output $\Delta T$ is input into an electronic calculator 29 which differentiates the signal $\Delta T$ to provide an output signal ($d(\Delta T)/dt$) indicative of the rate of temperature difference change. This output ($d(\Delta T)/dt$) may be input into the recorder 23 and also is input into a first adjustable voltage comparator 31 which has been preset to provide an output signal whenever the differentiated signal is equal to or exceeds a preset limit in the negative direction. The preset limit is set at a rate which is indicative of the presence of a water slug. For example, the first voltage comparator 31 may be preset to trigger if ($d(\Delta T)/dt$) is equal to or exceeds $-30°$ F/sec in the negative direction. The output of the first voltage comparator is connected to a first alarm 33.

The output $\Delta T$ of summing device 22 is also input into a second adjustable preset voltage comparator 35 which has been preset to provide an output voltage whenever the signal $\Delta T$ equals or falls below a preset temperature difference. For example, voltage comparator 35 may be preset to output a voltage whenever the temperature difference $\Delta T$ equals or falls below 30° F. The output of the second voltage comparator 35 is connected to a second alarm 37 which would indicate the presence of wet steam in the steam conduit.

The output voltage from the differential pressure switch 27 indicative of reverse flow in the steam conduit is input into a third alarm 39 and hence the following information is available. If the first alarm is triggered, the presence of a rapidly occurring steam condition change such as a water slug is indicated. If the second alarm is actuated, the presence of wet steam is indicated and if the third alarm is triggered a reverse flow in the steam conduit is indicated. In the present example of an extraction steam conduit the latter is likely to occur after a loss of load or could indicate a malfunction in the feedwater heater.

In addition to the foregoing, further logic means may be further incorporated in the system to cause the recorder chart to speed up during critical periods in order to provide a more detailed profile of turbine operating conditions. An OR gate 41 has a first connection to the output of the first voltage comparator indicative of the presence of a water slug. A second input connection to the OR gate 41 is from the output of an AND gate 43. AND gate 43 is connected to the outputs of the second voltage comparator 35 and the differential pressure switch 27 which together indicate the presence of wet steam flow in the reverse direction. Hence OR gate 41 will provide an output voltage whenever there is a water slug in either direction AND/OR whenever there is wet steam in the reverse direction. An output from OR gate 41 is input into a time delay relay 45 which then speeds up the recorder chart for more detailed monitoring. The time delay relay 45 will keep the recorder chart speed high for a predetermined time after the OR gate output has returned to zero in order to permit better observation of the end pahse of the disturbance.

OPERATION

Figure 2:
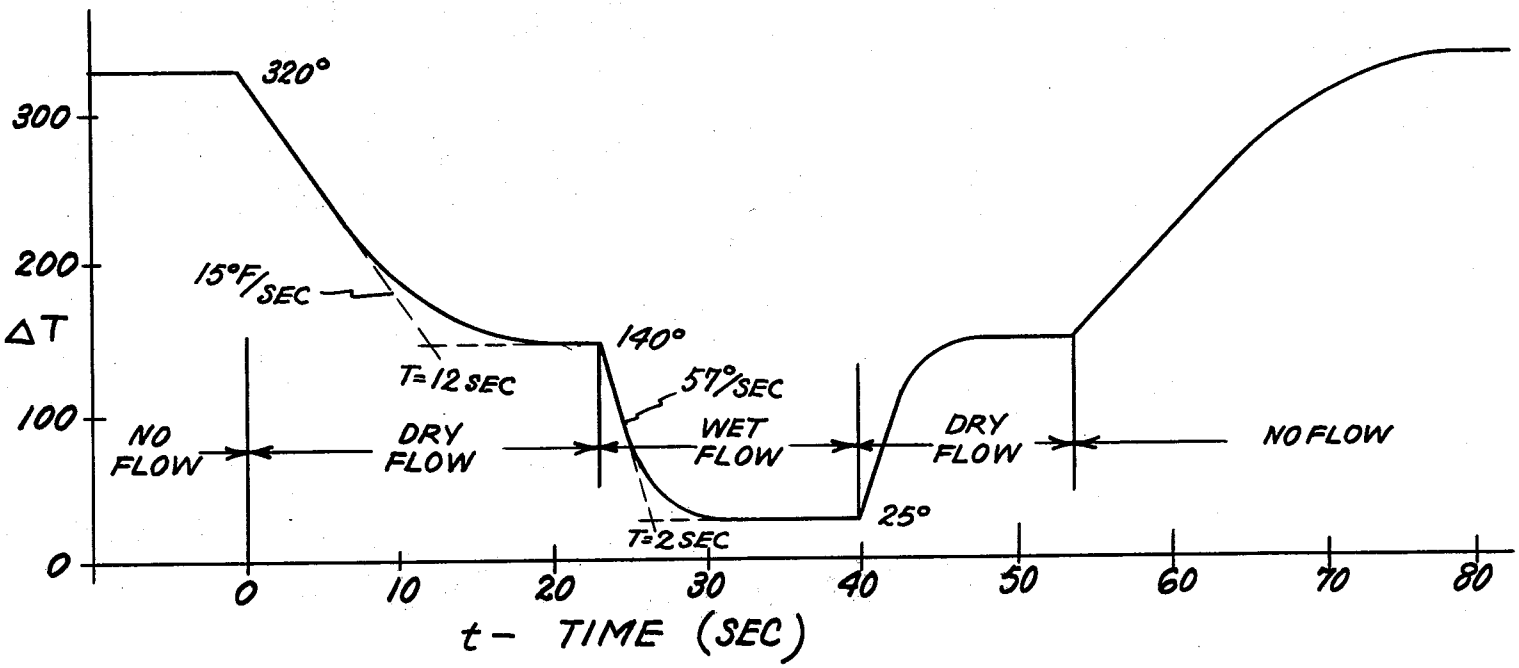
FIG. 2 is a sample graph showing temperature change versus time illustrative of the operation of the present invention.

FIG. 2 is a sample graph chart showing the temperature difference $\Delta T$ versus time $t$. In a no flow condition the temperature difference may be preset to 320° F. Under a dry flow condition, the temperature difference may fall to 140° F as illustrated with a slope ($d(\Delta T)/dt$) of $-15°$ F/sec. If the first voltage comparator is preset to provide an output whenever the slope is equal to or greater than 30° F/sec in the negative direction, then there will be no output from the voltage comparator. However, in the section labeled wet flow, the temperature difference has fallen to 25° F with a slope of $-57°$ F/sec in the negative direction. This, of course, would trigger both voltage comparators since the preset trigger voltage on the second voltage comparator is 30° F temperature difference. Also, the first voltage comparator would be initially triggered because of the slope of the line in the wet flow region. Additionally, if the flow in the wet region were in the reverse direction, the differential pressure switch would provide an additional output signal to the recorder and AND gate 43.

While there has been shown what is considered, at present, to be the preferred emobodiment of the invention, it is, of course, understood that various modifications may be made therein. It is intended to claim all such modifications as fall within the true spirit and scope of the invention.

What is claimed is:

1. A monitoring device for detecting the presence of an increased moisture content in a steam conduit comprising:

a first heated thermal sensing device disposed in the steam conduit;

a second ambient thermal sensing device disposed in the steam conduit;

a pressure-sensitive directional probe disposed in the steam conduit; and, logic means receiving the respective outputs of said first and second thermal sensing devices for determining the presence of increased moisture content in said steam conduit, said logic means also receiving the output of said directional probe for determining the flow direction in said steam conduit.

2. The monitoring device recited in claim 1 wherein the logic means comprise:

a summing device receiving the respective outputs of said first and second thermal sensing devices to determine a temperature difference;

means differentiating said temperature difference output from said summing device to determine a rate of change in said temperature difference output;

a first preset voltage comparator connected to said differentiating means to provide an output voltage whenever the rate of change in said temperature difference equals or exceeds a preselected limit; and, a second preset voltage comparator connected to the output of said summing device to provide an output voltage whenever the temperature difference output equals or is below a preselected limit.

3. The monitoring device recited in claim 2 wherein the logic means further comprise:

a preset differential pressure switch connected to said pressure-sensitive directional probe to provide an output voltage whenever a preselected pressure difference is exceeded in a reverse direction.

4. The monitoring device recited in claim 3 wherein the logic means further comprise:

an AND gate connected to the respective outputs of said second voltage comparator and the pressure switch;

an OR gate connected to the respective outputs of said first voltage comparator and the AND gate; and, a preset time delay relay connected to the output of said OR gate.

5. The monitoring device recited in claim 4 further comprising:

a recorder device connected to receive the respective outputs from said first and second thermal sensing devices, from said differentiating means, from said pressure switch and from said time delay relay whereby the time delay relay sets the recorder speed or operation.

6. In combination with a steam turbine, a monitoring device for determining the presence of wet steam and water slugs in a steam extraction line, said monitoring device comprising:

a first heated thermal sensing device disposed in said extraction line;

a second ambient thermal sensing device disposed in said extraction line;

a pressure-sensitive directional probe disposed in the extraction line; and, logic means receiving the respective outputs of said first and second thermal sensing devices for determining the presence of wet steam and water slugs in said extraction line, said logic means also receiving the output of said directional probe for determining the flow direction in said extraction line.

7. The combination recited in claim 6 wherein the monitoring device logic means further comprise:

a summing device receiving the respective outputs of said first and second thermal sensing devices to determine a temperature difference;

means differentiating said temperature difference output from said summing device to determine a rate of change in said temperature difference output;

a first preset voltage comparator connected to said differentiating means to provide an output voltage indicative of a water slug; and, a second preset voltage comparator connected to the output of said summing device to provide an output voltage indicative of wet steam.

8. The combination recited in claim 7 wherein the monitoring device logic means further comprises:

a preset differential pressure switch connected to said pressure-sensitive directional probe to provide an output voltage indicative of reverse flow in the extraction line.

9. The combination recited in claim 8 wherein the monitoring device logic means further comprises:

an AND gate connected to the respective outputs of said second voltage comparator and the pressure switch whereby an output from the AND gate is indicative of wet steam in the reverse direction; and, an OR gate connected to the respective outputs of said first voltage comparator and the AND gate whereby an output from the OR gate is indicative of a water slug in either direction and/or wet steam in the reverse direction.

10. The combination recited in claim 9 wherein the monitoring device further comprises:

a time delay relay connected to the output of said OR gate; and, a recorder connected to the respective outputs of said time delay relay, the first and second thermal sensing devices, the pressure switch and the differentiating means.

11. The combination recited in claim 8 wherein the monitoring device further comprises:

a first alarm connected to the output of the first voltage comparator;

a second alarm connected to the output of the second voltage comparator; and, a third alarm connected to the output of the pressure switch.

* * * * *